United States Patent [19]

Johnson et al.

[11] 4,061,074

[45] Dec. 6, 1977

[54] AMMUNITION FEED MECHANISM

[75] Inventors: Curtis D. Johnson, Davenport, Iowa; Larry C. McFarland, Silvis, Ill.; Lonnie D. Antwiler, Fenton, Mo.

[73] Assignee: The United States of America as represented by the Secretary of the Army, Washington, D.C.

[21] Appl. No.: 716,841

[22] Filed: Aug. 23, 1976

Related U.S. Application Data

[63] Continuation-in-part of Ser. No. 610,024, Sept. 3, 1975, Pat. No. 3,999,461.

[51] Int. Cl.[2] ..... F41D 9/02

[52] U.S. Cl. ..... 89/33 CA

[58] Field of Search ..... 89/33 BC, 33 CA, 33 MC

[56] References Cited

U.S. PATENT DOCUMENTS

| | | | |
|---|---|---|---|
| 321,513 | 7/1885 | Maxim | 89/33 CA |
| 2,113,202 | 4/1938 | Stange | 89/33 CA |
| 2,454,251 | 11/1948 | Hamilton | 89/33 CA |
| 2,466,578 | 4/1949 | Corte | 89/33 BC |
| 2,710,477 | 6/1955 | Simpson | 89/33 CA |
| 2,792,761 | 5/1957 | Simpson | 89/33 CA |
| 2,793,567 | 5/1957 | Kamp | 89/33 MC |
| 3,367,236 | 2/1968 | Menneking | 89/33 CA |
| 3,456,553 | 7/1969 | Novotny et al. | 89/33 BC |
| 3,648,561 | 3/1972 | Stoner | 89/33 CA |
| 3,999,461 | 12/1976 | Johnson et al. | 89/33 CA |

*Primary Examiner*—Stephen C. Bentley
*Attorney, Agent, or Firm*—Nathan Edelberg; Harold Card, Jr.; Robert O. Richardson

[57] ABSTRACT

An ammunition feed mechanism for a machine gun includes a sprocket having cartridge feeding and positioning splines. This sprocket rotates in a feed direction to move a belt of linked cartridges into position for chambering and firing. An anti-backup pawl prevents counterrotation and maintains the sprocket in position while a cartridge is chambered. A ratchet release permits bidirectional rotation of the sprocket in loading and unloading of the ammunition belt. The rotation of the sprocket for feeding is done with a cam tube actuator making a ratchet connection with the sprocket. The reciprocating movement of the bolt carrier causes rotary movement of the actuator by means of a pin on the bolt carrier riding in the cam of the actuator. The bolt carrier has a depressible rammer for chambering the cartridges. This permits the bolt carrier to override a subsequently positioned cartridge during carrier recoil instead of the conventional recoiling of the carrier before subsequent moving of the next cartridge to its feed position.

10 Claims, 6 Drawing Figures

AMMUNITION FEED MECHANISM

GOVERNMENT RIGHTS

The invention described herein may be manufactured and/or used by or for the Government for governmental purposes without the payment of any royalty thereon.

CONTINUATION-IN-PART

This application is a continuation-in-part of pending patent application Ser. No. 610,024 filed Sept. 3, 1975 for Modular Lightweight Squad Automatic Weapon System, now U.S. Pat. No. 3,999,461 which issued Dec. 28, 1976.

BACKGROUND OF PRESENT INVENTION

Conventional self-powered machine gun feed mechanisms are typically of the reciprocating transverse variety. This type of mechanism incorporates a feed lever, generally located near the top of the weapon, which pivots in a rather large feed cover and tray member. As the bolt carrier reciprocates it moves the feed lever back and forth. The feed lever actuates a pawl which advances belted rounds of ammunition to the feed position. The rounds are held in this position by another pawl, which is also controlled by the feed lever. This is a complex mechanism consisting of many moving parts, springs, etc. For example, there are 75 parts in the feed mechanism of the M60 machine gun now in use. Obviously a mechanism of this type would be more susceptible to failure or breakage than one containing fewer parts.

Another disadvantage of this prior art system is that the feed cover is pivotally mounted at its forward end and must be pivoted upward in order to load or clear the weapon. This is a shortcoming because, from the prone position, a gunner would have to expose too much of himself to accomplish the loading or clearing function, to his possible detriment.

SUMMARY OF PRESENT INVENTION

The ammunition feed mechanism of the present invention includes a sprocket rotatably mounted on a support. This sprocket has three rows of cartridge positioning teeth or splines spaced apart by cylindrical sections. As the sprockets rotates in a feed direction, the center splines engage the links to move the belted rounds of ammunition into a feed position from which they may be chambered. The center splines also eject the links freed by the chambering of their associated cartridges. The freed links pass over fingers in the cylindrical sections which prevent jamming as the links are ejected from the weapon. A cam tube actuator rotates the sprocket as the bolt carrier moves from its battery position to its position of recoil. This rotation is caused by longitudinal movement of a pin connected to the bolt carrier. This pin rides in the cam of the actuator to impart rotational movement to it.

The cam tube actuator has a drive ratchet which engages and rotates the sprocket in one direction in the feeding operation and an anti-backup pawl prevents counterrotation of the sprocket during the chambering cycle of the bolt carrier. However, a ratchet release is provided to permit bidirectional rotation of the sprocket in loading and unloading of the ammunition belt.

The bolt carrier has a depressible rammer for chambering cartridges as it moves to battery position. This permits the bolt carrier to override a subsequently positioned cartridge during carrier recoil instead of the conventional recoiling of the carrier before subsequent moving of the next cartridge to its feed position. This provides smoother and more reliable operation.

In a preferred embodiment wherein the receiver comprises vertically spaced, horizontally positioned parallel tubes, the feed mechanism apparatus is positioned on the lower tube which serves as its mounting structure. By using this existing mounting structure and by using the existing bolt carrier movement to cause sprocket rotation, the number of parts necessary to feed belted ammunition to a position for chambering (by counterrecoil of the bolt carrier) is reduced to approximately $\frac{1}{3}$ the number of parts used in previous feed mechanisms.

DETAILED DESCRIPTION OF ILLUSTRATIVE EMBODIMENT

Figure 1:
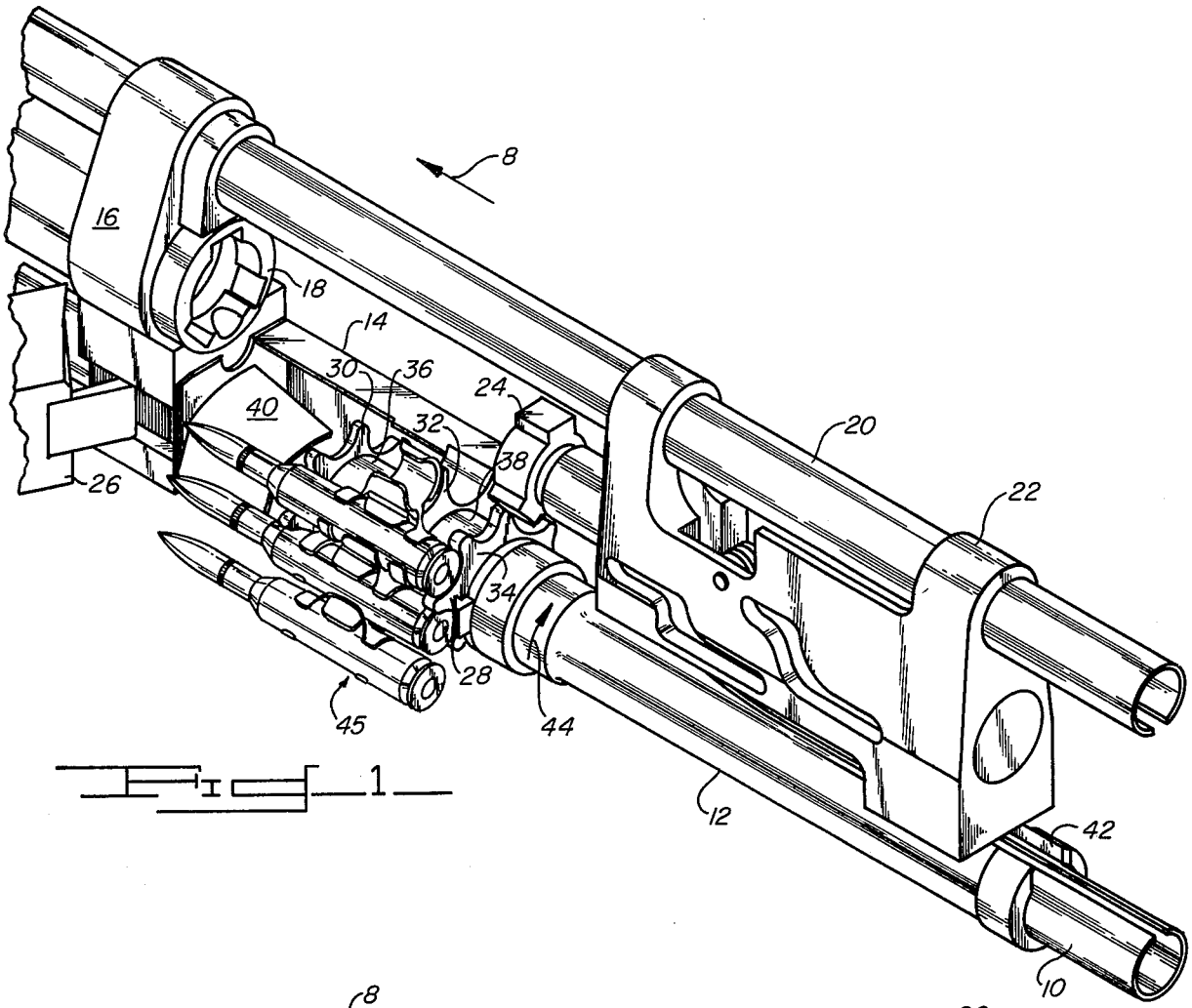
FIG. 1 is a perspective view showing the components of the ammunition feed mechanism.

Reference is now made to FIG. 1 which shows in perspective the assembled parts of the feed mechanism. The gun points in the direction of arrow 8, as it does in subsequent views. Here there is shown the feed mechanism positioned over the lower receiver tube 10. This mechanism includes the feed cam assembly 12 and the feed box assembly 14, positioned rearwardly of the receiver end cap 16 and gun barrel extension 18. Mounted on the upper receiver tube 20 is the bolt carrier 22 carrying bolt 24. The feed port door 26 is pivotally mounted on the end cap 16. The feed box assembly 14 contains a feed sprocket 28 which is rotatably mounted on lower tube 10. This feed sprocket consists of three rows of teeth or splines 30, 32 and 34, spaced apart by cylindrical sections 36 and 38. Also fastened on feed box assembly 14 is a guide spring 40 which guides the cartridges during chambering.

In operation, assume that the bolt 24 in bolt carrier 22 is engaged with the barrel extension 18 and the carrier is at rest at its interface with the end cap 16. During firing the bolt carrier 22 recoils rearwardly to the position shown in FIG. 1. During this recoil, the drive pin and roller, not shown in FIG. 1, engages a sprial camway 42 of the feed cam assembly 12, causing it to rotate in the direction of arrow 44. This rotation causes the sprocket 28 to positively advance or rotate in the direction of arrow 44 to move the link belted ammunition 45 into a feed position, so that a live cartridge may subsequently be advanced into the chambered position during the counterrecoil of bolt carrier 22 (movement in the direction of arrow 8). There is a ratchet means, more fully described hereinafter, which will allow the counterrotation of the feed cam assembly 12 (in a direction opposite to that of arrow 44) during the counterrecoil movement of the bolt carrier 22. The feed cam assembly 12 is then in a position to advance the sprocket 28 during the next recoil cycle when the next feed operation takes place.

Figure 2:
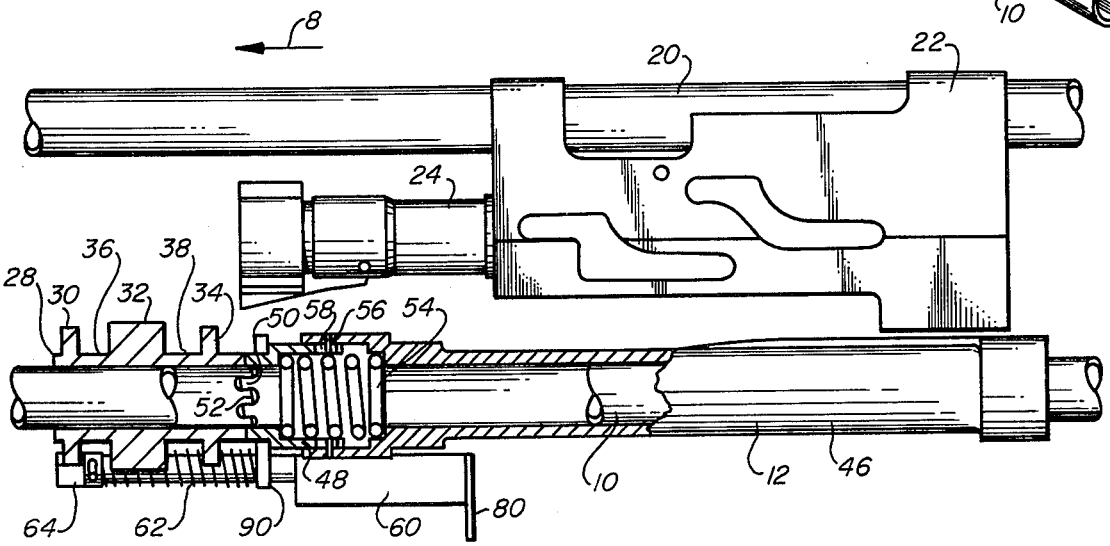
FIG. 2 is a left side elevation view partially in section showing the ratchet drive mechanism.

The details of the ratcheting structure is best shown in FIG. 2 where parts are broken away to more clearly show this structure. Here is shown the feed cam assembly 12 rotatably mounted over the lower tube 10. This assembly consists of the feed cam tube 45 having at its inner end a drive ratchet 48. This ratchet has a row of seven teeth 50 that engage with a mating row of seven teeth 52 on the feed sprocket 28. Drive ratchet 48 is telescopically movable in an axial direction within cam tube 46 and is urged outwardly by spring 54. It is retained in the assembly by pins 56 in slots 58 of the drive ratchet. Also shown in FIG. 2 is a ratchet release assembly 60 which is positioned and retained by the feed box (not shown). This ratchet release assembly 60 can be moved rearwardly, that is, to the right, by the operator and in opposition to spring 62 for the purpose of reloading or downloading the weapon. When the operator pulls rearwardly on the ratchet release handle 80 of the ratchet release assembly, it disengages the ratchet 48 from the feed sprocket 28. It also disengages the sprocket anti-backup pawl 64 from sprocket teeth 30 and disengages the feed door latch so the door, shown in FIG. 6, may be opened for loading, unloading or to clear a jam.

Figure 3:
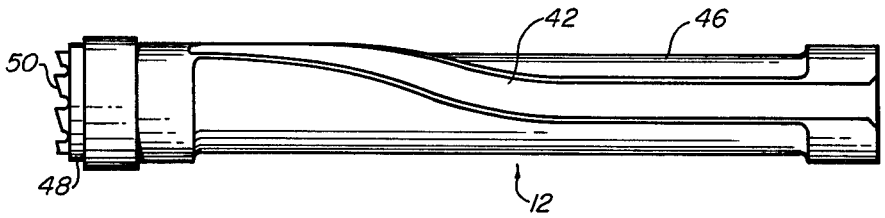
FIG. 3 is a plan view of the cam tube assembly.

FIG. 3 shows the feed cam assembly 12 with a spiral cam path 42. It can be seen that as a pin moves from right to left within the groove, it will cause the assembly to rotate downwardly and as the pin moves from left to right it causes the assembly to rotate upwardly to advance the sprocket to the next position.

Figure 4:
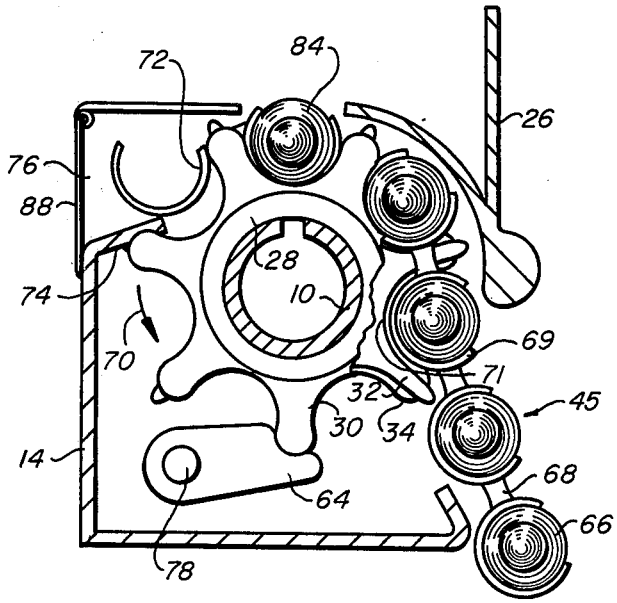
FIG. 4 is a front section in elevation illustrating the sprocket operation.

FIG. 4 is a front end view of sprocket 28 with some of the sprocket teeth 30 broken away to more clearly show the operation of the feed mechanism. Here is shown a belt of ammunition 45 consisting of cartridges 66 linked together by links 68. In this view the sprocket 28 rotates in a counterclockwise direction, shown by arrow 70, to advance each round into a feed position. Round 84 at the top is in this feed position from which chambering of the round will subsequently occur. The fore and aft rows of teeth 30 and 34 provide positive control of the rounds as they are rotated into the feed position. The center row of teeth 32 fit between the links around adjacent cartridges and the cartridge encircling portions 69 of links 68 are cradled in the recesses 71 between the teeth 32. This provides control of the links 68 and prevents their forward movement during the stripping process. Continued rotation of sprocket 28 pushes the empty links 72 through the link ejection port 76 and cover 88 after their associated rounds have been chambered. Other structure, described hereinafter with reference to FIG. 5, will strip the uppermost cartridge 84 from the linkage and move it into the barrel extension 18 into a chambered position ready for firing. When this cartridge is moved forward, it frees the link 72 for ejection during the next feed cycle. Fingers 74 on feed box assembly 14 bear toward the cylindrical sections 36 and 38 of the feed sprocket 28 to lift the freed linkage out and away from the sprocket 28 so that it may be ejected through link port 76.

Also shown in FIG. 4 is the anti-backup pawl 64 which engages the front teeth 30 of the feed sprocket 28 to permit unidirectional rotation only of sprocket 28 in the direction of arrow 70. This pawl also accurately positions sprocket 28 so that top round 84 is in feed position. This anti-backup pawl 64 pivots on a pin 78 which is the forward extension of the ratchet release assembly 60 shown in FIG. 2. Pawl 64 is urged into the positive engagement as shown by the torsional aspects of spring 62 which has both compressional and torsional capabilities. As previously mentioned, this pawl may be disengaged by pulling rearwardly on ratchet release handle 80, shown in FIG. 2, for loading and unloading of the cartridge belt from the gun.

Figure 5:
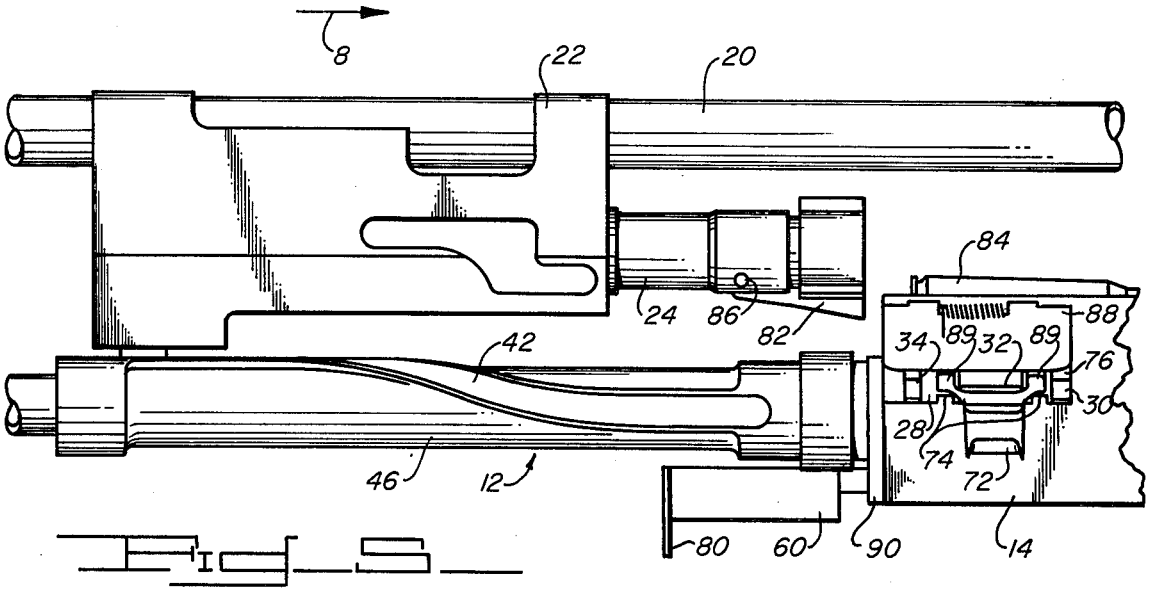
FIG. 5 is a right side elevation view showing the link ejection apparatus.

FIG. 5 is a right side elevational view showing the rammer 82 prior to engagement with the round 84 in the feed position. Counterrecoil movement of the bolt carrier 22 and bolt 24, in the direction of arrow 8, provides engagement of the rammer 82 with the round 84. Further movement strips the round 84 from the link and positions it in the weapon chamber. The rammer 82 is pivotally mounted to the bolt 24 by a pin 86 and biased downwardly by a spring (not shown). This eliminates the need for additional clearance cuts in the barrel extension 18 to accomodate the rammer at the "in battery" position of the bolt 24. More importantly, since the rammer can be pivoted up over the next round to be fed, the next feed cycle can be initiated immediately upon recoil of the bolt carrier 22. Since the entire duration of recoil can be used for feeding, much smoother operation is achieved. In prior art designs a solid lug is used as a rammer. The lug must therefore pass the base of the round before the round can be moved to the feed position. This accounts for the violent jerking action of the ammunition belt in conventional machine guns which does not occur in the present feed system. FIG. 5 shows the link 72 being ejected. Legs 89 of link 72 are carried by fingers 74 on feed box assembly 14 which are inwardly directed toward cylinder portions 36 and 38 of sprocket 28. The link ejection port 76 is provided with a pivotally mounted spring biased cover 88 to prevent foreign particles from entering the mechanism.

Figure 6:
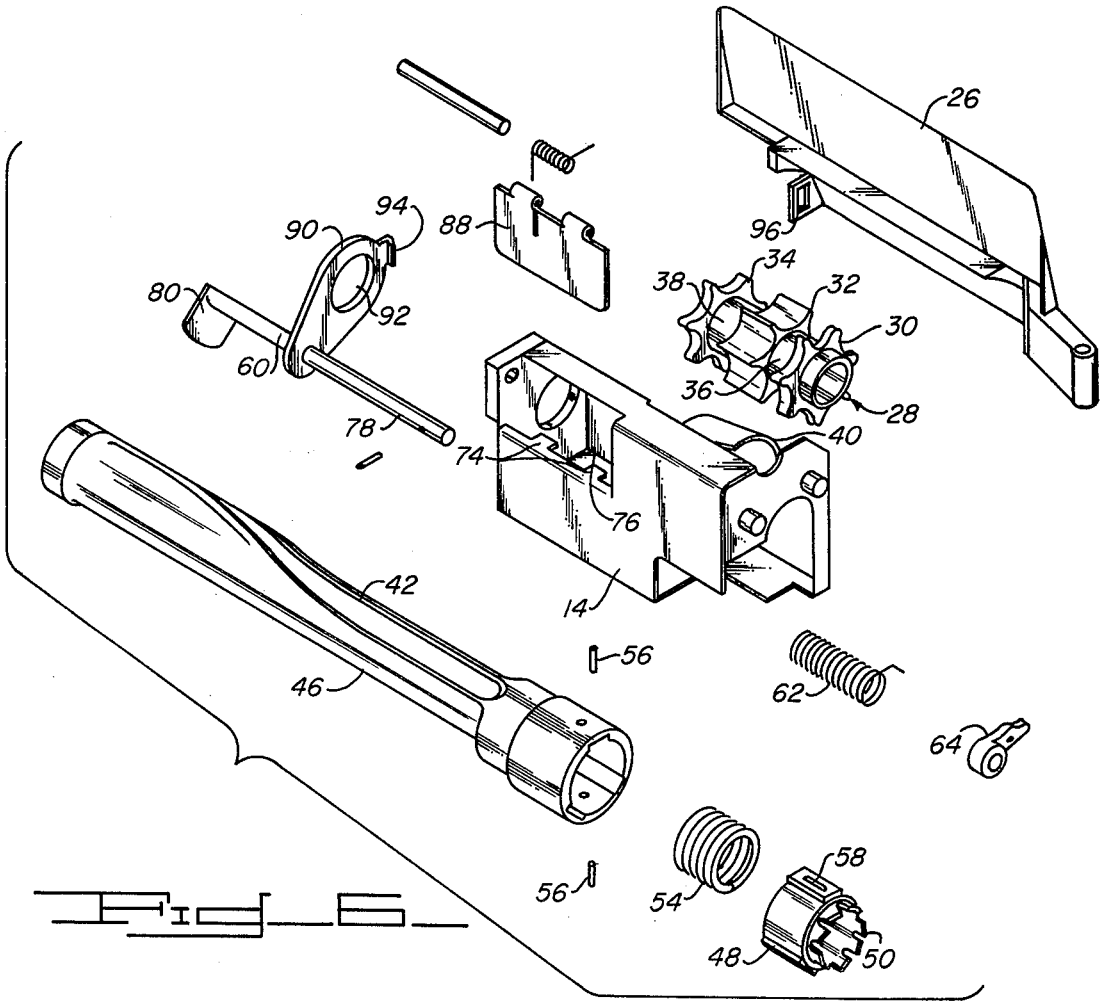
FIG. 6 is an exploded view showing the feed system components.

FIG. 6 is an exploded view showing the feed system components separately in perspective. In this view the structure of the ratchet release can be seen. The ratchet release assembly 60 supports a plate 90. When assembled the teeth 50 on the drive ratchet 48 protrude through the opening 92 in plate 90. The plate then rests against the shoulder of the drive ratchet 48. When the ratchet release handle 80 is pulled rearwardly the plate 90 pulls the drive ratchet 48 out of engagement with sprocket teeth 52. The plate 90 also carries a latch 94 which engages slot 96 to retain the feed port door 26 in the latched position until the ratchet release handle 80 is pulled.

The invention in its broader aspects is not limited to the specific combinations, improvements and instrumentalities described but departures may be made therefrom within the scope of the accompanying claims without departing from the principles of the invention and without sacrificing its chief advantages.

What is claimed is:

1. A belted ammunition feed mechanism for a gun having a bolt carrier, said mechanism comprising:

a rotatable sprocket, said sprocket having first and second end rows of teeth between which rounds of ammunition may be cradled, said sprocket having a center row of teeth both radially and axially longer than the teeth in said first and second end rows and extending between adjacent round connecting links to prevent their forward movement while associated rounds cradled between adjacent teeth are stripped forwardly and chambered by the bolt carrier on said gun, said center row of teeth having recesses between said adjacent teeth in which the cartridge encircling portions of said links are cradled.

2. A belted ammunition feed mechanism as set forth in claim 1, and means operable by said bolt carrier to rotate said sprocket.

3. A belted ammunition feed mechanism as set forth in claim 2, wherein said sprocket is rotated during the recoil cycle of said bolt carrier.

4. A belted ammunition feed mechanism as set forth in claim 3 wherein said bolt carrier has a depressible rammer to permit its override over a cartridge during said recoil cycle.

5. A belted ammunition feed mechanism as set forth in claim 2 wherein said means is a rotary cam actuator driven by a pin on said bolt carrier.

6. A belted ammunition feed mechanism as set forth in claim 5 wherein said actuator has a ratchet connection with said sprocket whereby said sprocket rotates in one direction during feeding operation, and a pawl connection with said sprocket to prevent its counterrotation during the chambering cycle of said bolt carrier.

7. A belted ammunition feed mechanism as set forth in claim 6, and release means to disengage said ratchet connection and said pawl connection to permit bidirectional rotation of said sprocket for loading and unloading of said belted ammunition.

8. A belted ammunition feed mechanism as set forth in claim 7 wherein said ratchet connection is made with ratchet teeth on said sprocket and ratchet teeth on said actuator, said ratchet teeth on said actuator being axially depressible by said release means.

9. A belted ammunition feed mechanism as set forth in claim 1 wherein said sprocket has front and back cartridges cradling teeth and a middle set of link holding teeth spaced from said cradling teeth by cylindrical portion on said sprocket.

10. A belted ammunition feed mechanism as set forth in claim 9 wherein fingers on said gun extend toward said cylindrical portions to carry freed links being ejected.

* * * * *